US005669192A

United States Patent [19]

Opdyke et al.

[11] Patent Number: 5,669,192

[45] Date of Patent: Sep. 23, 1997

[54] CLADDING FOR DOOR AND WINDOW FRAMES

[75] Inventors: Joseph Opdyke, Collegeville; Kenneth L. Laubsch, Chalfont; Joseph DeMeo, Newtown Square, all of Pa.

[73] Assignee: Benjamin Obdyke Incorporated, Warminster, Pa.

[21] Appl. No.: 638,300

[22] Filed: Apr. 26, 1996

[51] Int. Cl.[6] ..... E06B 1/04

[52] U.S. Cl. ..... 52/211; 52/212

[58] Field of Search ..... 52/211, 212, 213, 52/718.01, 718.04; 49/505, 504, 489, 460, 462

[56] References Cited

U.S. PATENT DOCUMENTS

| | | |
|---|---|---|
| 3,340,665 | 9/1967 | Kohl . |
| 3,591,985 | 7/1971 | Coppins . |
| 3,975,875 | 8/1976 | Goss, Jr. . |
| 4,193,238 | 3/1980 | Chalmers et al. . |
| 4,341,048 | 7/1982 | Minter . |
| 4,389,824 | 6/1983 | Anderson . |
| 4,430,830 | 2/1984 | Sailor . |
| 4,658,548 | 4/1987 | Gerritsen . |
| 5,018,325 | 5/1991 | Geen et al. . |
| 5,022,204 | 6/1991 | Anderson . |
| 5,058,323 | 10/1991 | Gerritsen . |
| 5,203,130 | 4/1993 | Freelove . |
| 5,222,343 | 6/1993 | Anderson . |
| 5,444,954 | 8/1995 | Anderson . |

OTHER PUBLICATIONS

Alum–A–Pole Corp. brochure for Pro–Trim Moulding™ and Bendable Vinyl Coil, Copyright 1994, 2 pages.

*Primary Examiner*—Carl D. Friedman
*Assistant Examiner*—Creighton Smith
*Attorney, Agent, or Firm*—Howson and Howson

[57] ABSTRACT

A do-it-yourself kit for retrofitting without special tools protective weatherproof cladding on an existing door or window frame assembly. Three elongate one-piece sections of extruded plastic are prefabricated in transverse cross section to match the profile of the exterior exposed surfaces of two sides and the header of the frame assembly. Lengthwise portions of each section are folded to grip and secure under friction door stop or sash guide surfaces of the frame assembly. Tabs extending from mitered upper ends of the side sections underlap mitered ends of the header section. Templates are included in the kit for cutting the lower ends of the side sections to match the profile of the door threshold or window sill.

10 Claims, 2 Drawing Sheets

FIG. 1
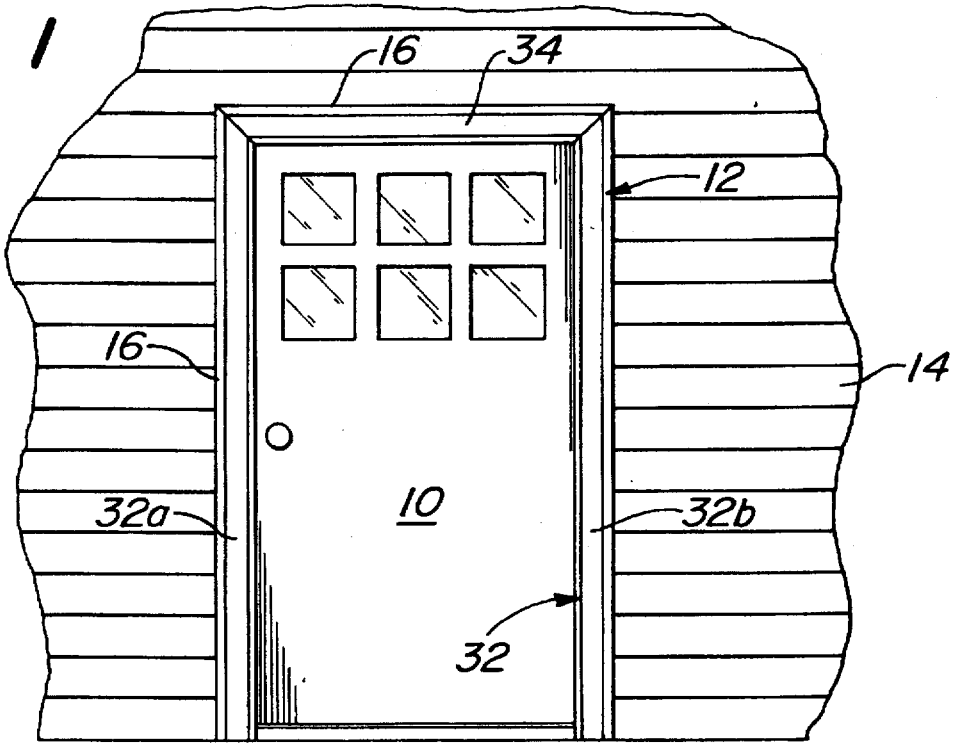
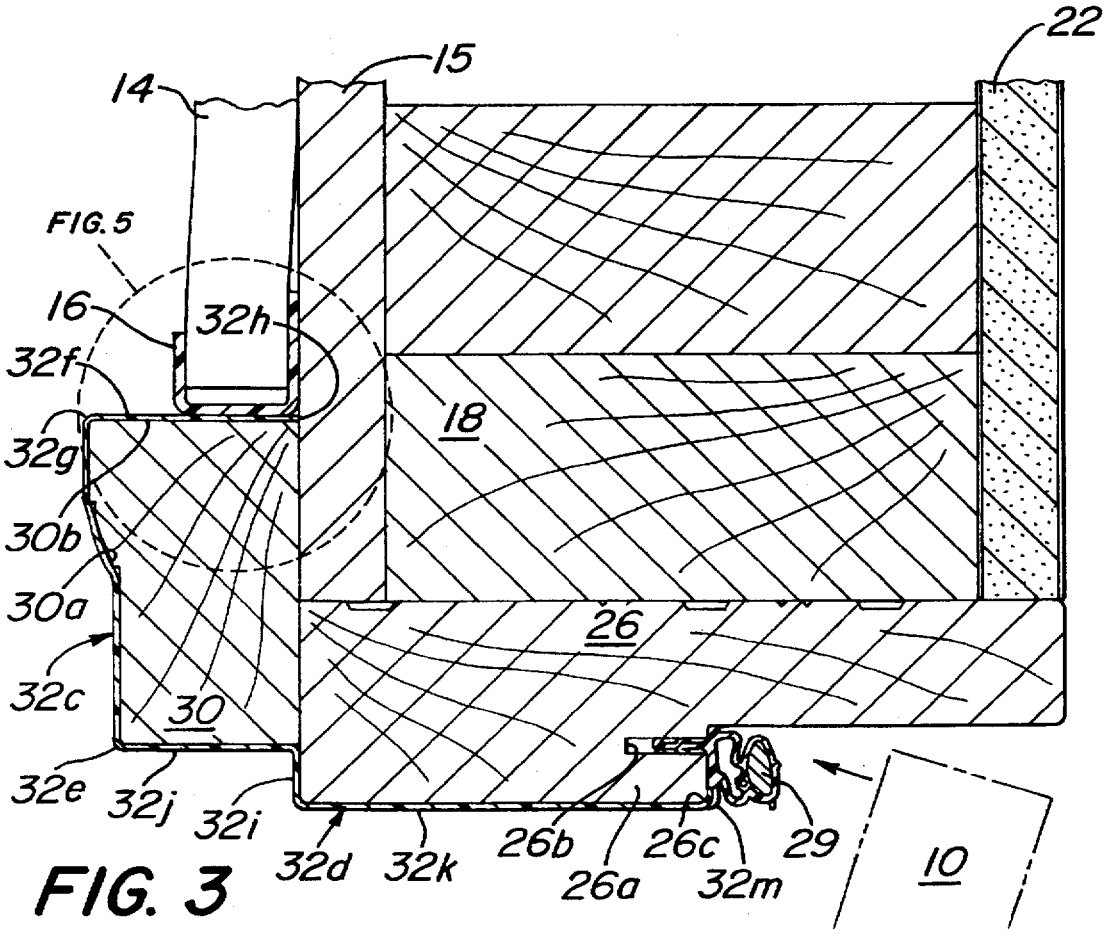
FIG. 3

FIG. 2
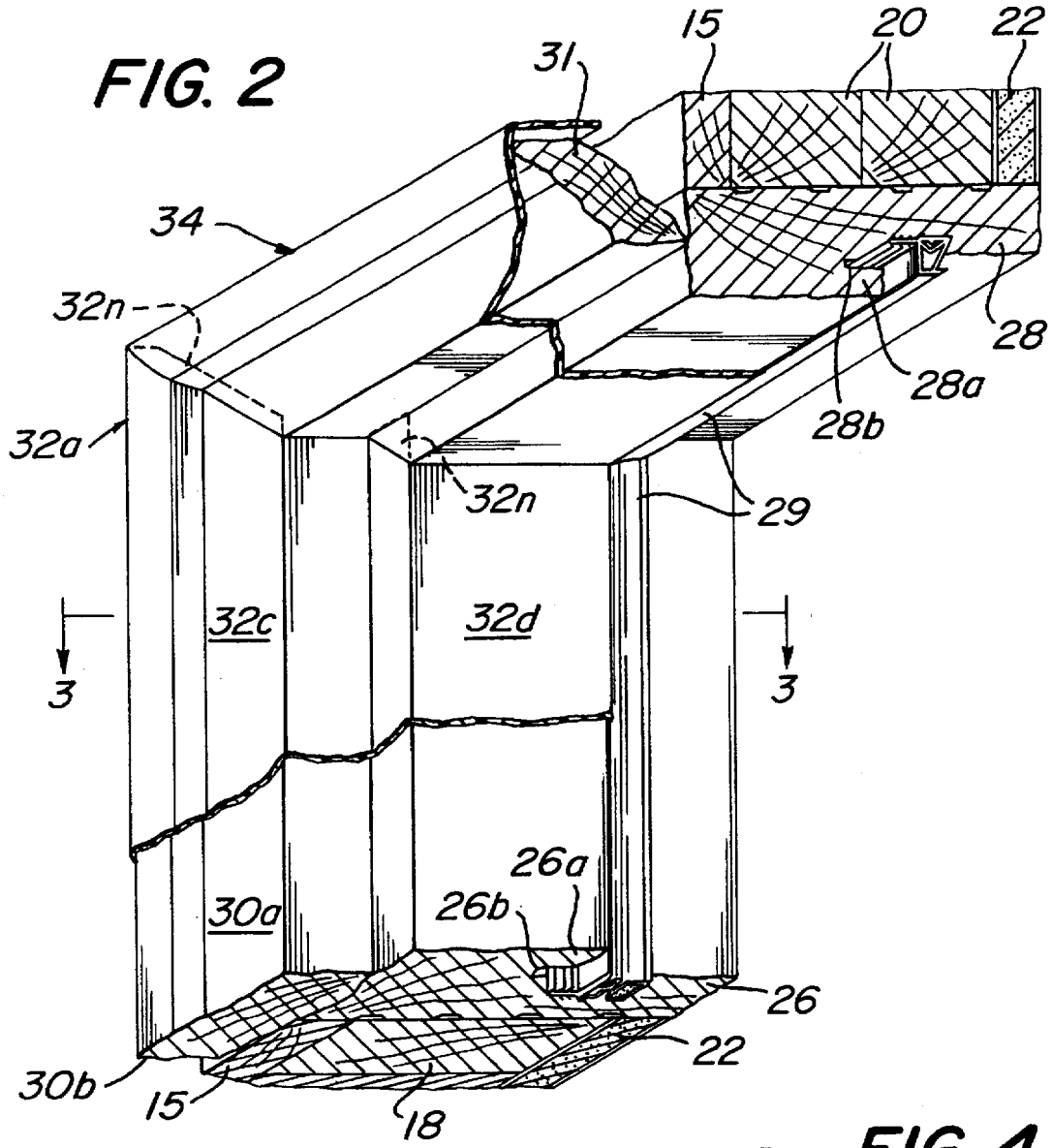
FIG. 4
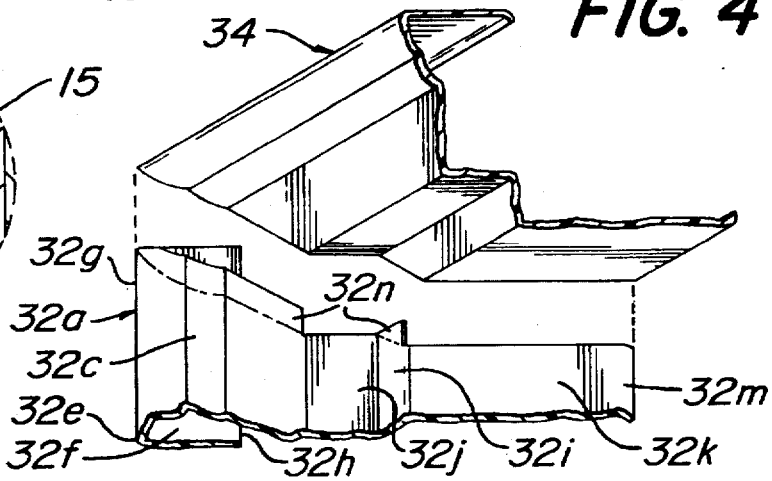
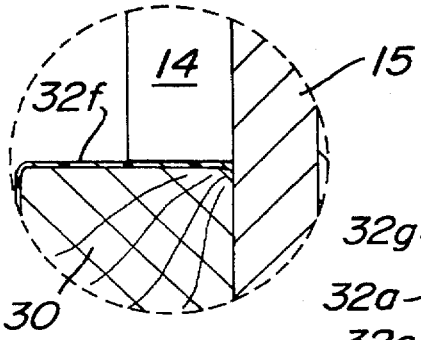
FIG. 5

CLADDING FOR DOOR AND WINDOW FRAMES

FIELD OF THE INVENTION

This invention relates generally to cladding for door and window frames, and more particularly to prefabricated do-it-yourself components suitable for cladding the outside surfaces of a door or window frame without specialty tools.

BACKGROUND OF THE INVENTION

Door and window frames, particularly in older buildings, are usually constructed of wood or metal, requiring their exterior surfaces be periodically painted, varnished or similarly coated in order to maintain protection from exposure to weather and other deteriorating and corrosive environments. In some cases built-up coatings must be removed and reapplied.

These measures are labor intensive and expensive over the long term. Consequently, refurbishment of commercial and residential buildings often includes retrofitting the door or window frame with a protective cladding. A commonly used type of cladding consists of aluminum strips cut from rolls and mitered to size and bent lengthwise on the job site using special tools to conform in transverse cross section with the exterior surface profile of the frame which is usually decorative. However, once installed, the aluminum cladding is easily dented. A more rigid type of cladding is made of extruded plastic strips shaped in cross section to match the exterior surface profile of standard, commercially available frames. To cover the entire outer surface, several overlapping strips, such as disclosed in U.S. Pat. No. 5,203,130, are often required. In many of these installations, special fasteners and receptor strips, visible in the completed installation, are required to hold the cladding in place. Consequently, installation can be difficult and better left to experienced installers with special tools.

OBJECTS OF THE INVENTION

Accordingly, it is an object of the present invention to provide a do-it-yourself kit for cladding the outside surfaces of a standard size door or window frame, and which can be easily installed by persons without previous experience and without special tools.

Another object is to provide self-securing one-piece cladding sections for retrofitting exterior surfaces of an existing door or window frame with a protective covering which does not extend into the interior surfaces of the frame or interfere with door or window operation.

Still another object is to provide prefabricated cladding which will hold in frictional engagement with the exterior surfaces of a door or window frame, and which can be installed directly adjacent to existing exterior siding or to J-strips retaining such siding.

A further object is to provide components of prefabricated cladding components for a door or window frame which are relatively inexpensive to manufacture, are durable in adverse environments, and are substantially maintenance free.

SUMMARY OF THE INVENTION

These and other objects of the invention are accomplished with a do-it-yourself kit of prefabricated components for providing a retrofit weatherproof cladding over an existing standard door and window frame. The complete kit comprises two elongate side sections and one elongate header section of high-impact resistant extruded plastic for covering the exterior surfaces of the door or window frame. The sections, in transverse cross section, each match the exterior, usually decorative, surface profile of the door or window jamb, door stop or sash guide, and exterior trim or so-called brick mold. A lengthwise portion or lip along one edge of each section folds inward around the door stop or sash guide and grips in frictional engagement the inner surface against which the door closes or the window slides. A lengthwise portion or flange along the opposite edge of each section folds inward around the outer perimeter of the brick mold and grips in frictional engagement the flange which meets the surface of the exterior wall. In a door frame having weather stripping secured to the door stop, the folded lip fits snugly in frictional engagement between the weather stripping and the door stop.

If J-strips exist around the door or window frame to retain siding against exterior sheathing, the folded flange fits snugly between the J-strip and the brick mold.

The header section is mitered at opposite ends, and each side section is mitered with tabs extending from one end for underlying a mitered end of the header section. The header section is also pre-cut in different lengths to fit various standard door frame widths, but the side sections are provided in one length which can be easily cut on the job site to accommodate shorter frame heights. Several templates, not shown, are also provided to aid in cutting off the lower ends of the side sections to fit various standard door threshold or window sill profiles. Caulking may be applied to seal the side and header sections where they overlap and where the side sections meet the threshold or sill.

BRIEF DESCRIPTION OF THE DRAWINGS

The foregoing objects, novel features and advantages of the invention will become more apparent from the following description of the preferred embodiment when taken in conjunction with the accompanying drawings wherein:

FIG. 1 is a front elevation view of a door in a frame with cladding according to the invention installed directly against J-strips holding exterior siding in place;

FIG. 2 is a fragmentary isometric view of the upper left corner of the door frame and cladding of FIG. 1;

FIG. 3 is a view in cross section of the door frame and cladding taken along the line 3—3 of FIG. 2;

FIG. 4 is a fragmentary exploded view of the cladding of FIG. 2 without the door frame; and FIG. 5 is a view in cross section like FIG. 3 of a door frame with the cladding according to the invention installed directly against exterior siding.

DESCRIPTION OF THE PREFERRED EMBODIMENT

Referring now to the drawings wherein like-referenced characters denote like or corresponding parts throughout the several views, there is illustrated a building aperture such as typical door 10 hung in a standard door frame, indicated generally by the number 12, with siding 14 held in place by standard J-strips 16 on an exterior sheathing 15 (FIG. 3) adjacent to the outer perimeter of the frame.

Door frame 12 is mounted in an opening formed of a pair of trimmer studs 18 on opposite sides (only one being shown) and a header 20 between an interior wallboard 22 and exterior sheathing 15. The frame includes a pair of side jambs 26 fixed next to respective ones of studs 18, and a header jamb 28 fixed next to header 20. Jambs 26 and 28 are equal in width to the thickness of the wall between the inner and outer surfaces of wallboard 22 and sheathing 15, respectively. Door stops 26*a* and 28*a* are integrally formed along the entire inner perimeter of the jambs and include kerfs 26*b* and 28*b* retaining a resilient weather stripping 29 for positively sealing the door opening when the door is closed. In some cases the door stops are separate pieces which are nailed or bonded to the flat exposed sides of the jambs. Door frame 12 further includes exterior trim or brick molds 30 and 31 which extend lengthwise along the exterior edges of jambs 26 and 28 and bridges widthwise portions of the surface along the exterior edges and adjacent exterior portions of sheathing 15.

The surface of door frame 12, which would normally be exposed to the external environment, is completely covered by a prefabricated weatherproofing cladding strip 32 according to the invention. The cladding strip is preferably of white, textured and high-impact resistant extruded PVC plastic, consisting of two elongate side sections 32*a* and 32*b* (FIG. 1) and an elongate header section 34. The configuration of the sections are substantially identical and will therefore be described with reference to section 32*a*, but with any differences noted herein.

As best seen in FIGS. 2–4, side section 32*a* defines a fascia portion 32*c* formed to accurately match the contours, angles and dimensions of the brick mold fascia 30*a* which it covers. An inner flange 32*d* along one edge 32*e* of fascia portion 32*c* is inturned generally orthogonal thereto, i.e. at an angle of approximately 90 degrees, to engage an inner edge 26*c* of door stop 26*a* for frictionally gripping the inner surface facing weather stripping 31. An outer flange 32*f* along an opposite edge 32*g* of fascia portion 32*c* is inturned generally orthogonal thereto, i.e. at an angle of approximately 90 degrees, to engage the perimeter of brick mold 30 for frictionally gripping an outer surface 30*b* thereof facing J-strips 16.

Outer flange 32*f* has a predetermined length terminating in a free edge 32*h*. A length of about 1½ inches has been found desirable for the outer flange 32*f*. Inner flange 32*d* has a predetermiend length greater than the length of the outer flange 32*f*, and includes an offset 32*i* which is substantially coplanar with the free edge 32*h* of outer flange 32*f*. Preferably, edge 32*h* is located closely adjacent the plane of offset 32*i* to provide a small clearance for installation. Offset 32*i* divides the inner flange 32*d* into a short section 32*j* disposed parallel to outer flange 32*f* and a long section 32*k* extending substantially parallel to the plane of section 32*j* which terminates in an inturned narrow lip 32*m*. An overall length of 2⅝ inches has been found desirable for inner flange 32*d*. Inner and outer flanges 32*d* and 32*f* extend in parallel relation from fascia portion 32*c*.

In the above manner, cladding 32 and 34 cover all exposed exterior surfaces without extending into the interior living space or interfering with the door operation, and the gripping edges of the side and header sections obviate a need for receptor strips or similar hidden or visible pieces secure the installation completely.

Cladding header section 34 is pre-mitered at an angle of 45 degrees at opposite ends in various lengths to fit different standard door frame widths, and side sections 32*a* and 32*b* are fabricated in one length which can be shortened at the lower end to accommodate a specific door height. Each side section 32*a* and 32*b* is pre-mitered at an angle of 45 degrees with tabs 32*n* at one end of each for underlapping the mitered ends of header section 34 to divert water from the corner joints without requiring corner caps. The other end of sides 32*a* and 32*b* are square cut to allow them to be trimmed to fit the particular height of the frame and profile of the threshold or sill.

Some of the many advantages and novel features of the invention should now be readily apparent. For example, a prefabricated do-it-yourself kit is provided which enables cladding of outside surfaces of a door or window by persons without previous installation experience and without special tools. The cladding is self-securing and especially suitable for retrofitting exterior surfaces of existing standard size door and window frames. The cladding is positively secured to the exterior surfaces of the frame by friction but is also preferably nailed or bonded where frame surfaces have deteriorated. The cladding can also be installed directly to existing exterior siding or to J-strips retaining such siding. The prefabricated cladding is relatively inexpensive to manufacture, is durable in adverse environments and is substantially maintenance free.

It will be understood, of course, that various changes in the details, materials, steps and arrangement of parts, which have been described and illustrated in order to explain the nature of the invention, may be made by those skilled in the art without departing from the scope of the invention as expressed in the appended claims.

We claim:

1. In a system that protects the exterior surface of a frame assembly including a header member and opposed side members defining an opening in a wall, the header and side members each having inner surfaces with weather strip edges, the frame assembly also including a brick molding having a fascia portion and inner and outer edges, the improvement comprising:

first and second one-piece cladding strips engaging respective ones of the side members; and a third one-piece cladding strip engaging the header member;

each of said cladding strips including:

a cladding fascia portion positioned against the brick mold fascia portion;

an inturned outer flange of a predetermined length terminating in a free edge, said inturned outer flange engaged with the outer edge of said brick mold;

an inturned inner flange having a predetermined length greater than said outer flange length, said inner flange having a narrow offset disposed in a plane substantially coplanar with the free edge of said outer flange, said offset dividing said inner flange into sections of unequal length with a shorter one of said sections being disposed parallel to said outer flange and engaged with the inner edge of said brick mold, and a longer of said sections extending substantially parallel to the shorter section and engageable with said header and side jamb inner surfaces, said longer section terminating in an inturned lip engaged with said weather strip edge;

whereby the cladding strips are retrofitted on a pre-existing installed frame by pushing the cladding strips against the frame and fastening them together.

2. The improvement according to claim 1 wherein said third cladding strip has opposed beveled ends joining said first and second strips at right angles at facing beveled ends of respective ones of said first and second cladding strips.

3. The improvement according to claim 2 wherein said first and second cladding strips have tabs extending from the beveled ends underlapping respective ones of the beveled ends of said third strip.

4. The improvement according to claim 3 wherein said first and second cladding strip are of one length suitable for shortening to fit different heights of the side members.

5. A cladding system for use with a frame having two opposed side jambs and a header, the frame having a fascia portion and inner and outer edges extending along an opening, a one-piece molded plastic cladding member, comprising:

a cladding fascia portion adapted to be positioned against the frame fascia portion;

an inturned outer flange of a predetermined length terminating in a free edge;

an inturned inner flange having a predetermined length greater than said outer flange, said inner flange having a narrow offset disposed in a plane substantially coplanar with the free edge of said outer flange, said offset dividing said inner flange into sections of unequal length with a shorter one of said sections being disposed parallel to said outer flange and a longer of said sections extending substantially parallel to the shorter section;

whereby the cladding is for retrofitting on a pre-existing installed frame by pushing the cladding against the frame for fastening the cladding to the frame.

6. The cladding member according to claim 5 wherein said longer section terminates in an inturned lip.

7. The cladding member according to claim 5 wherein said inner and outer flanges extend in parallel relation from said fascia portion and are disposed orthogonal thereto.

8. The cladding member according to claim 5 where said free edge of said outer flange terminates at a location between the plane of the offset and the cladding fascia and proximate the plane of the offset.

9. The cladding according to claim 5 wherein said cladding member is extruded of PVC material.

10. A cladding system for use with a frame having two opposed side jambs and a header, the header having an inner surface and the side jambs each having inner surfaces; each frame also including a brick mold with a fascia portion and inner and outer edges, comprising a one-piece molded plastic cladding strips for covering said frame, each strip comprising:

a fascia portion adapted to be positioned against the brick mold fascia portion;

an inturned outer flange of a predetermined length terminating in a free edge, said inturned outer flange engageable with the outer edge of said brick mold;

an inturned inner flange having a predetermined length greater than said outer flange, said inner flange having a narrow offset disposed in a plane substantially coplanar with the free edge of said outer flange, said offset dividing said inner flange into sections of unequal length with a shorter one of said sections being disposed parallel to said outer flange and engageable with the inner edge of said brick mold, and a longer of said sections extending substantially parallel to the shorter section and engageable with said header and side jambs inner surfaces; said longer flange section terminating in an inturned lip;

whereby the cladding strips are for retrofitting on a pre-existing installed frame by pushing the cladding strips against the frame for fastening the cladding to the frame.

* * * * *